US005685421A

United States Patent [19]

Gilmore

[11] Patent Number: 5,685,421

[45] Date of Patent: Nov. 11, 1997

[54] STORAGE BOX FOR TOOLS AND OTHER ITEMS

[76] Inventor: Benjamin E. Gilmore, 638 6th St., Hermosa Beach, Calif. 90254

[21] Appl. No.: 671,753

[22] Filed: Jun. 28, 1996

[51] Int. Cl.[6] ..... A45C 15/06

[52] U.S. Cl. ..... 206/216; 206/349; 16/110.5; 362/156; 362/191

[58] Field of Search ..... 206/216, 349; 362/154, 156, 190, 191; 16/114 R, 115, 110 R, 110.5

[56] References Cited

U.S. PATENT DOCUMENTS

| | | | |
|---|---|---|---|
| 1,231,146 | 6/1917 | Ferry . | |
| 1,309,541 | 8/1919 | O'Neel . | |
| 3,231,730 | 1/1966 | Wagner . | |
| 3,606,511 | 9/1971 | Henning et al. . | |
| 3,938,132 | 2/1976 | Cunningham . | |
| 4,571,740 | 2/1986 | Kirby et al. . | |
| 4,643,494 | 2/1987 | Marleau . | |
| 4,855,881 | 8/1989 | Pence . | |
| 5,143,440 | 9/1992 | Trampota . | |
| 5,169,226 | 12/1992 | Friedman | 362/190 |
| 5,219,446 | 6/1993 | Klepac . | |
| 5,257,169 | 10/1993 | Walendziak | 362/154 |
| 5,331,761 | 7/1994 | Kuthy | 206/216 |
| 5,333,408 | 8/1994 | Simmons | 362/154 |
| 5,459,648 | 10/1995 | Courtney | 362/154 |

*Primary Examiner*—Paul T. Sewell
*Assistant Examiner*—Luan K. Bui
*Attorney, Agent, or Firm*—Burns, Doane, Swecker & Mathis, L.L.P.

[57] ABSTRACT

A storage box for storing tools and various other items includes a lower box portion and a cover hinged to the lower box portion. The storage box also includes a flashlight that is removably positioned in a recess in the cover. The flashlight and the cover of the storage box are specifically configured to allow the light beam emitted by the flashlight to be adjusted over a wide range. The cover is also provided with a handle for carrying the storage box. The handle is movable between a recessed stored position and an upright grasping position, and is specifically designed to be moved without having to move the flashlight. The storage box can also be provided with an arrangement for mounting one of a plurality of different accessory holding modules on the storage box.

21 Claims, 7 Drawing Sheets

STORAGE BOX FOR TOOLS AND OTHER ITEMS

FIELD OF THE INVENTION

The present invention relates generally to a box for storing a variety of items and more particularly pertains to a tool/storage box for storing tools and other types of implements.

BACKGROUND OF THE INVENTION

Tool boxes and other types of storage boxes are extensively used by a wide variety of people for different purposes. For example, tool boxes are used by tradesmen and others to store a collection of tools and allow the tools to be transported in a relatively easy manner. While known versions of these types of boxes are adequate for the purpose of storing and transporting tools and other items, they are somewhat limited in their usefulness.

In one respect, individuals working with tools sometimes find it desirable and even necessary to have access to a light source. Although a flashlight is useful in this regard, individuals working with tools and the like oftentimes do not have a free hand available to direct the light beam in the desired direction.

Proposals have been made in the past to outfit tool boxes and other types of storage boxes with a light source. For example, U.S. Pat. No. 4,855,881 discloses a box having a handle that is outfitted with a flashlight. However, because the flashlight is mounted on the handle, the light beam cannot be directed independent of the handle. That is, the light beam can only be directed in the direction of orientation of the handle. Further, the flashlight mounted on the handle cannot be adjusted to alter the direction of the light beam. U.S. Pat. No. 5,333,408 and U.S. Pat. No. 5,143,440 also describe storage type boxes suffering from similar deficiencies.

U.S. Pat. No. 3,938,132 describes a fishing tackle box provided with a light that is mounted in a ball joint type casing. While this construction provides some degree of adjustability with respect to the direction of the light beam, the box suffers from the disadvantage that the light cannot be removed from the box for use independent of the box. Further, the light is susceptible of becoming damaged because it cannot be moved to a position where it is unexposed to inadvertent contact.

Other proposals for outfitting different types of storage boxes with light sources are disclosed in U.S. Pat. No. 5,219,446, U.S. Pat. No. 3,231,730, U.S. Pat. No. 1,309,541 and U.S. Pat. No. 1,231,146. All of these storage boxes suffer from a variety of disadvantages and drawbacks such as those mentioned above.

It is seen, therefore, that a need exists for a tool/storage box that is outfitted with a light source and specifically designed to be highly useful and quite versatile.

A need also exists for a tool/storage box provided with a light source that is removable from the remainder of the box for use separate and apart from the box.

It would also be useful to provide a tool/storage box having a light source that is specifically adapted to be mounted on and removed from the box, and that is adapted to be adjusted in position while mounted on the box to adjust the direction of the light beam.

SUMMARY OF THE INVENTION

In accordance with the present invention, a storage box for storing a variety of items includes a lower box portion having an open top and a plurality of side walls bounding a recessed storage area for receiving a variety of items, a cover connected to the lower box portion and movable from one position in which the open top of the lower box portion is covered and another position in which the cover is moved away from the open top of the lower box portion to expose the storage area in the lower box portion, and a slot provided in the cover for removably receiving a flashlight. A flashlight is removably received in the slot and includes a handle portion and an illumination portion. The illumination portion of the flashlight is pivotally connected to the handle portion so that when the flashlight is received in the slot in the cover of the storage box the illumination portion of the flashlight is pivotable relative to the handle portion to direct a beam of light from the illumination portion in different directions.

According to another aspect of the present invention, a storage box for storing various items includes a lower box portion having an open top and a plurality of walls bounding a recessed storage area for receiving a variety of items, a cover connected to the lower box portion and movable from one position in which the open top of the lower box portion is covered and another position in which the cover is moved away from the open top of the lower box portion to expose the storage area in the lower box portion, and a handle mounted on the cover for carrying the storage box. A ledge is positioned on the lower box portion and a mounting arrangement is provided on the ledge for removably mounting one of a plurality of differently configured accessory holding modules. In addition, an accessory holding module which is adapted to hold an accessory is removably mounted on the mounting arrangement.

In accordance with another aspect of the invention, a storage box for storing a variety of items includes a lower box portion having an open top and a plurality of side walls bounding a recessed storage area for receiving a variety of items, a cover connected to the lower box portion and movable from one position in which the open top of the lower box portion is covered and another position in which the cover is moved away from the open top of the lower box position to expose the storage area in the lower box portion, and a flashlight receiving recess for removably receiving a flashlight. A flashlight having a handle portion and an illumination portion is removably received in the flashlight receiving recess. In addition, the storage box is provided with a handle receiving recess and a handle that is movably mounted on the cover for movement between a stored position in which the handle is received in the handle receiving recess and a grasping position in which the handle is adapted to be grasped for carrying the storage box. The handle is movable between the stored position and the grasping position while the flashlight is positioned in the flashlight receiving recess.

BRIEF DESCRIPTION OF THE DRAWING FIGURES

DETAILED DESCRIPTION OF THE INVENTION

For purposes of illustration in understanding the various desirable and advantageous characteristics associated with the storage box of the present invention, the storage box will be described below in the context of a tool box. It is understood, however, that the storage box can be used in other contexts where the storage and transportation of various items is required.

Figure 1:
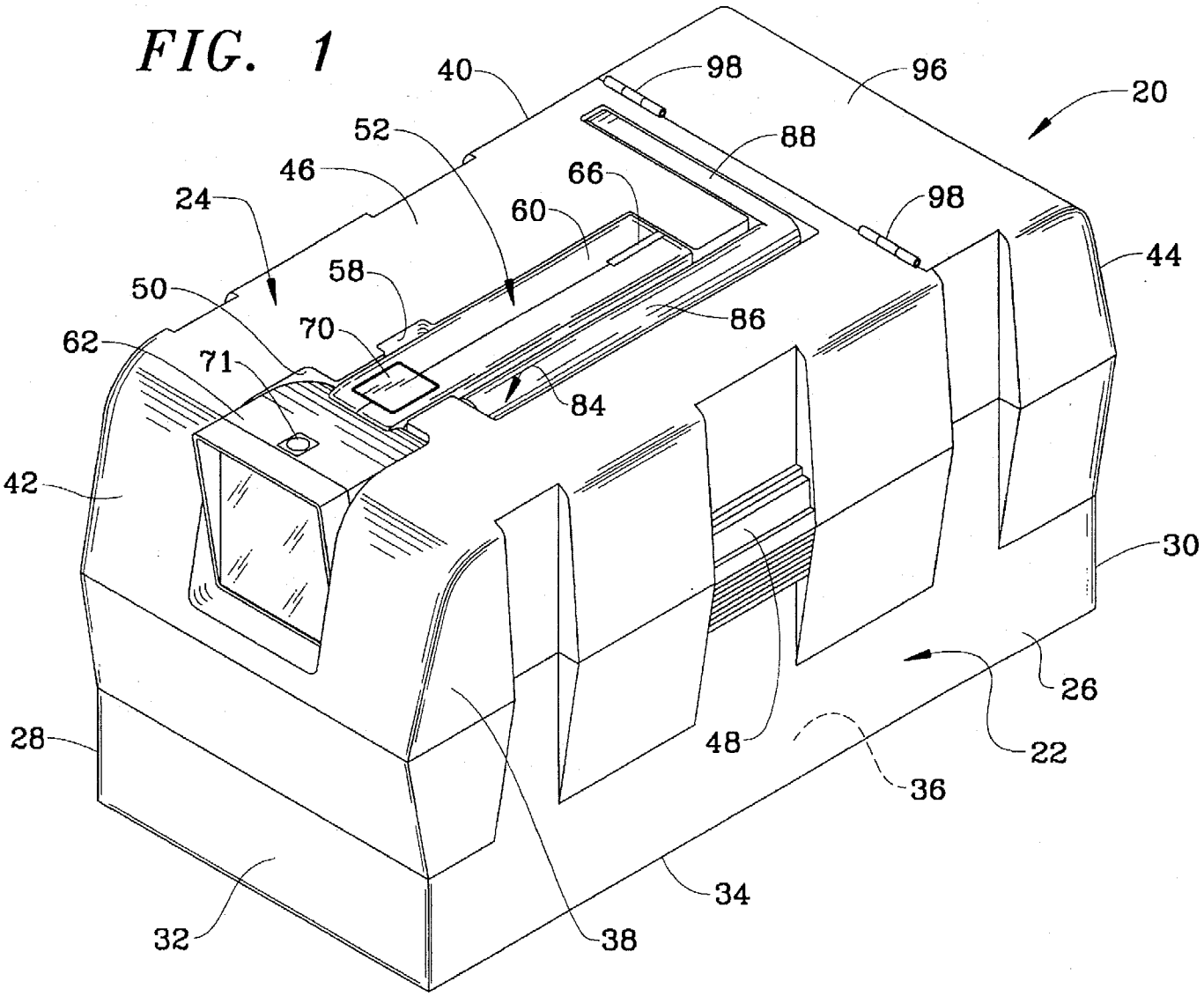
FIG. 1 is a top prospective view of one embodiment of the storage box of the present invention illustrating the illuminating portion of the flashlight oriented in one position and illustrating the handle in the recessed stored position.

As seen with reference to FIG. 1, the storage box 20 according to the present invention includes a lower box portion 22 and a cover 24. The lower box portion 22 is defined by a plurality of upstanding side walls, including a front wall 26 and an oppositely positioned rear wall 28, oppositely positioned end walls 30, 32, and a bottom wall 34. The lower box portion 22 is also provided with an open top positioned opposite the bottom wall 34. The various walls 26, 28, 30, 32, 34 together define and enclosed structure surround a hollow interior 36 of the storage box.

The cover 24 is designed to cover the open top of the lower box portion 22. The cover 24 is configured in a manner that substantially corresponds to the lower box portion 22 and is thus defined by a plurality of side walls, including oppositely positioned front and rear walls 38, 40, oppositely positioned end walls 42, 44 and a top wall 46.

The cover 24 is preferably connected to the lower box portion 22 by one or more hinges (not specifically shown in FIG. 1) disposed between the rear wall 28 of the lower box portion 22 and the rear wall 40 of the cover 24. In addition, a latch assembly 48 of known construction is preferably disposed on the front portion of the storage box to alternately permit and prevent the cover 24 from being opened relative to the lower box portion 22.

As further seen with reference to FIG. 1, the top wall 46 of the cover 24 is provided with a recess or slot 50. The slot 50 is designed to removably receive a flashlight 52, the details of which will be explained in more detail below. The features and characteristics associated with the flashlight receiving slot 50 are perhaps best illustrated in FIG. 6.

The flashlight receiving slot 50 includes a rearwardly located handle receiving portion 54 and a forwardly located illuminating element receiving portion 56. The handle receiving portion 54 is generally elongated and of substantially a constant width and depth. The illuminating element receiving portion 56 is both wider and deeper than the handle receiving portion 54. A cutout 58 is provided along one edge of the handle receiving portion 54 to facilitate removal of the flashlight 52 from the slot 50.

Figure 6:
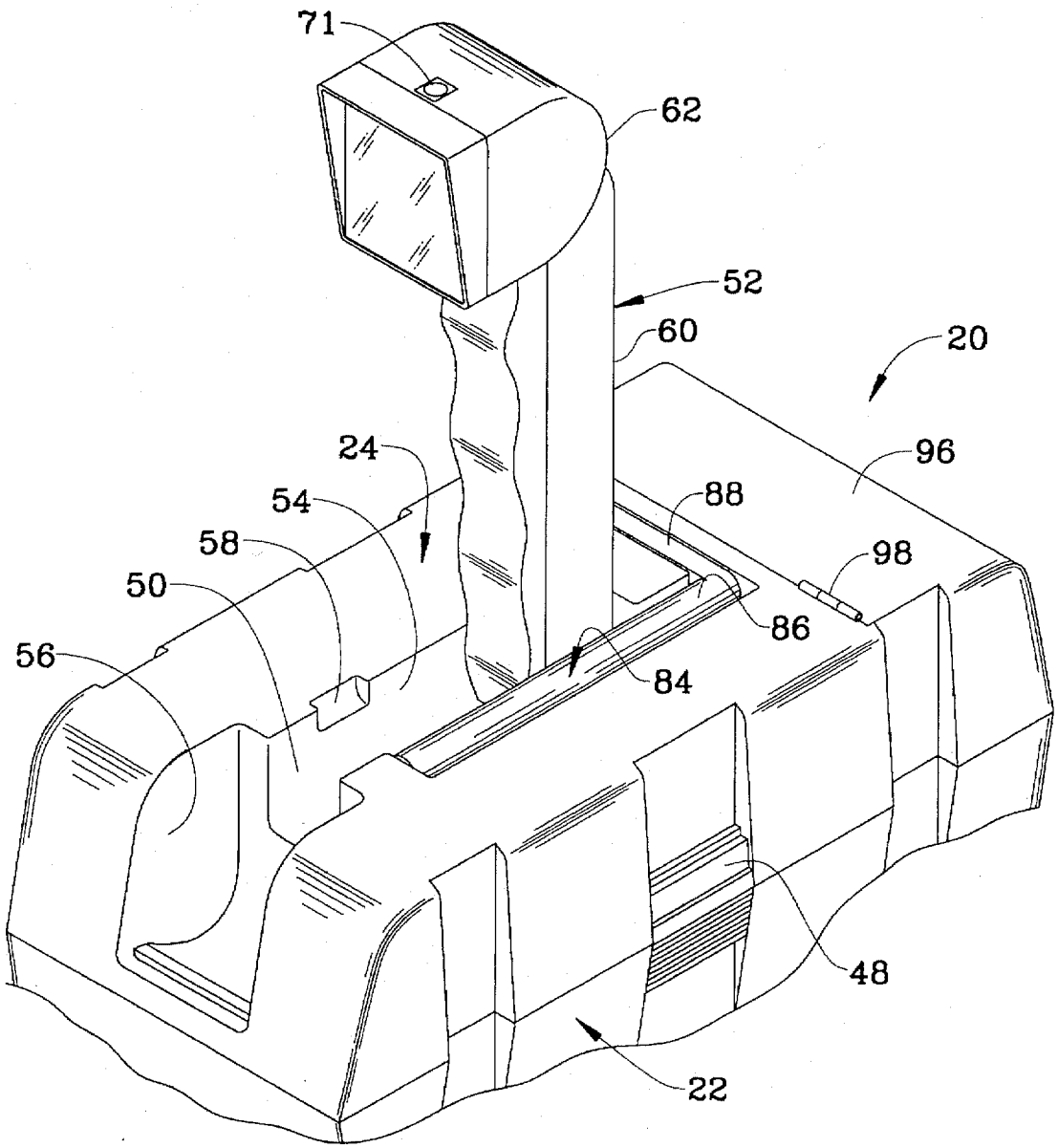
FIG. 6 is a top prospective view of a portion of the storage box shown in FIG. 1 illustrating the flashlight disposed in the upright position.
Figure 7:
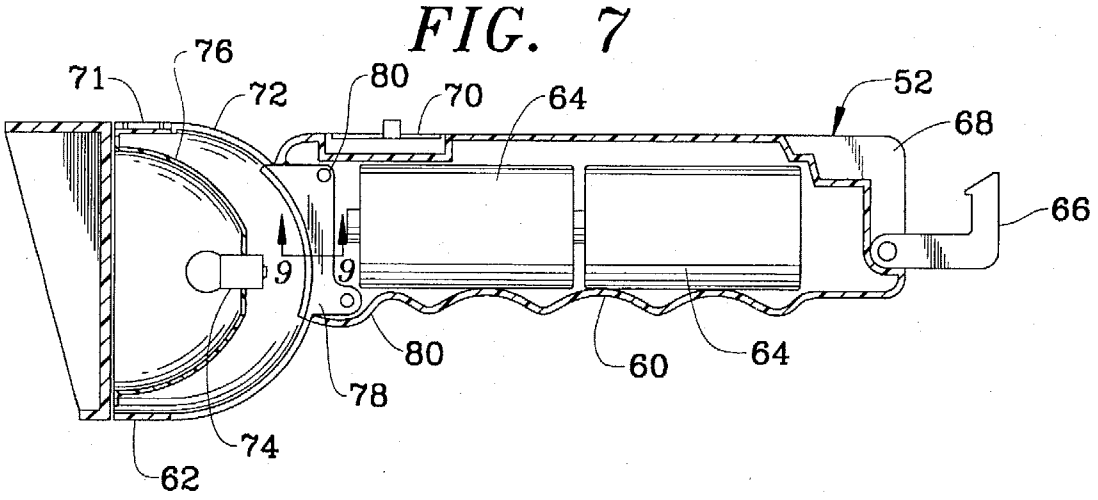
FIG. 7 is a cross-sectional view of the flashlight utilized in the storage box of the present invention.

The details associated with the flashlight 52 can be seen with reference to FIG. 7. The flashlight 52 includes a handle portion 60 and an illumination portion 62. The handle portion 60 of the flashlight 52 is adapted to be received in the handle receiving portion of the slot 50 shown in FIG. 6 while the illumination portion 62 of the flashlight 52 is adapted to be received in the illuminating element receiving portion 56 of the slot 50.

The handle portion 60 is generally elongated in shape and includes a hollow interior for housing a plurality of batteries 64 which provide a power source for the flashlight 52. A generally L-shaped hook element 66 is connected to the rear end of the handle portion 60 for movement between the extended position shown in FIG. 7 and a stored position in which the hook element 66 is stored in a recessed area 68 disposed along the rear and top regions of the handle portion 60. The hook element 66 allows the flashlight to be hung from any desired object such as a ladder, a car hood, etc. Positioned adjacent the forward end of the handle portion 60 along the upper surface is an on/off button 70 for effecting operation of the flashlight.

The illumination portion 62 includes a casing 72 in which is mounted a light bulb 74 and a reflector 76. The upper surface of the illumination portion 62 of the flashlight is also provided with a push button actuated and battery powered alarm or siren 71 which can be of known construction. The alarm or siren can be powered by the batteries that power the flashlight. This alarm or siren 71 provides a readily accessible mechanism for allowing an individual to identify an emergency or possibly also scare off an intruder or attacker.

The handle portion 60 is connected to the illumination portion 62 by way of a connecting bracket 78. The connecting bracket 78 is secured to the handle portion 60 through the provision of a pair of securing elements 80 such as rivets, screws or the like. The connecting bracket 78 is also slidably connected to the casing 72 of the illumination portion 62.

Figure 9:
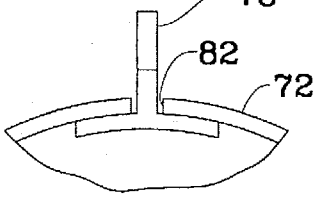
FIG. 9 is a cross-section along the section line 9—9 in FIG. 7 illustrating the way in which the handle portion of the flashlight is connected to the illumination portion of the flashlight.

As seen more clearly in FIG. 9, the connecting bracket 78 is generally T-shaped and a portion of the bracket extends through a slot 82 provided in the casing 72. This connection allows the illumination portion 62 of the flashlight 52 to be pivoted or rotated relative to the handle portion 60 so that the light beam can be directed in different directions.

The end of the handle portion 60 located closest to the illumination portion 62 preferably bears against the outer surface of the casing 72 so that a relatively tight frictional engagement is achieved between the connecting bracket 78 and the inner surface of the casing 72. In this way, the frictional engagement allows the illumination portion 62 of the flashlight to be adjusted to any desired orientation relative to the handle portion 60 while at the same time allowing the illumination portion 62 to be maintained in a particular orientation relative to the handle portion 60.

The ability of the illumination portion 62 of the flashlight 52 to be adjusted relative to the handle portion 60 is advantageous in several respects. First, as noted above, the flashlight 52 is designed to be removed from the flashlight receiving recess 50 in the top of the cover 24. Thus, when the flashlight 52 is removed from the top of the cover 24, the adjustable nature of the illumination portion 62 provides greater usefulness and versatility of the flashlight since the light beam can be directed in different directions.

Figure 3:
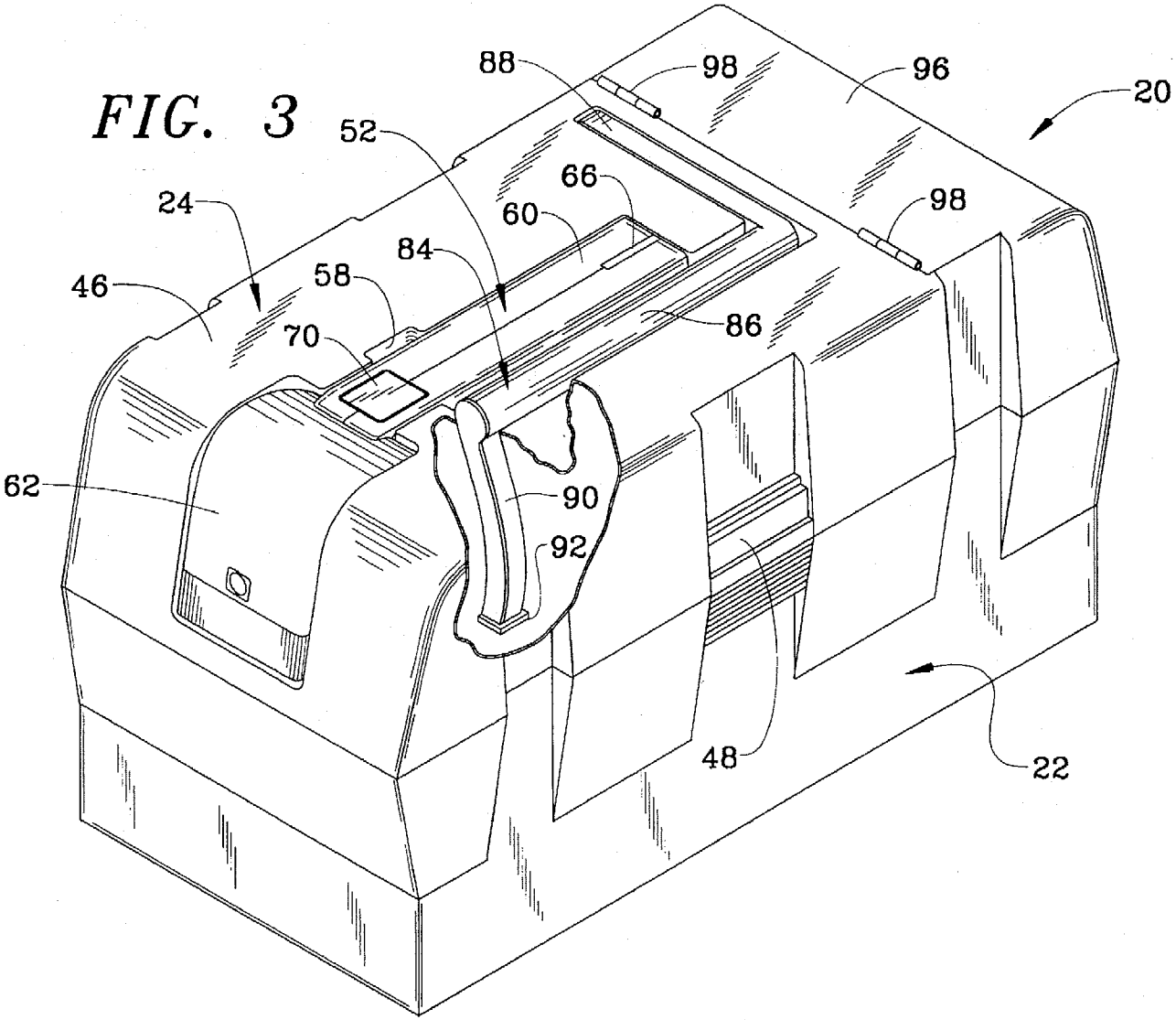
FIG. 3 is a top prospective view of the embodiment of the storage box shown in FIG. 1 illustrating the illuminating portion of the flashlight in a different position and illustrating a cut away portion of the cover.

The adjustable nature of the illumination portion 62 of the flashlight is also advantageous when the flashlight is positioned in the slot 50 in the top of the cover 24. As shown in FIG. 3, it is possible to turn the illumination portion 62 of the flashlight downwardly so that the front of the flashlight is directed downwardly into the recess. As can be seen with reference to FIG. 6, the bottom wall of the illuminating element receiving portion 56 of the slot 50 is somewhat rounded to permit movement of the illumination portion 62 of the flashlight relative to the handle portion 60 when the flashlight is positioned in the slot 50. Thus, when the light is not being used, the illumination portion can be pivoted to the stored position shown in FIG. 3 to avoid damaging the flashlight.

On the other hand, as shown in FIG. 1, the illumination portion can be rotated or pivoted in a plane perpendicular to the top of the cover 24 to a position facing in the direction of longitudinal extent of the box (i.e., in the forward direction when the box is being carried). This position of the illumination portion 62 provides a path of illumination for an individual carrying the box. In addition, the box can be positioned on a surface and oriented in a desired direction to illuminate a particular area.

Figure 2:
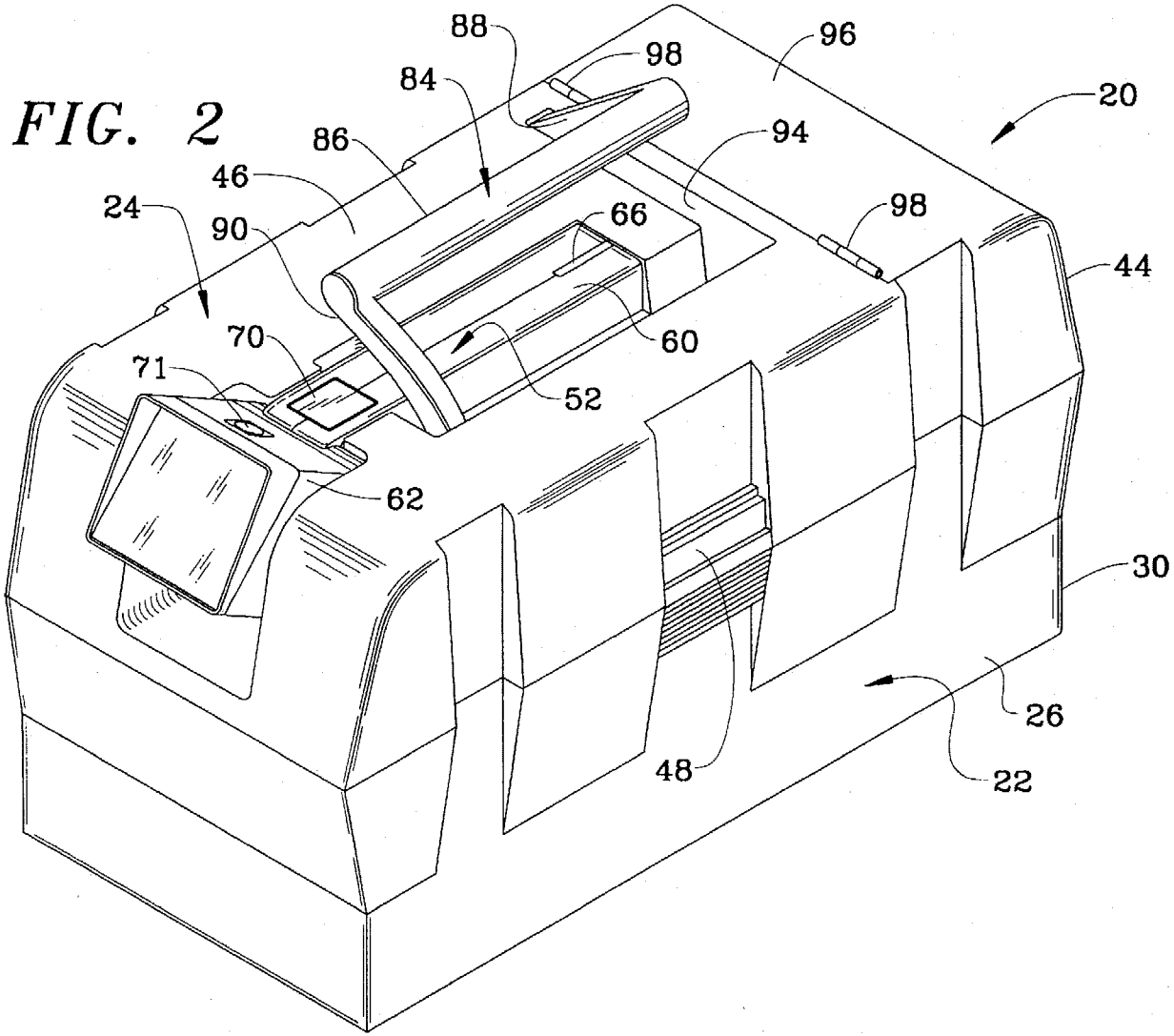
FIG. 2 is a top prospective view of the embodiment of the storage box depicted in FIG. 1 illustrating the illuminating portion of the flashlight in a different position and illustrating the handle in the upright grasping position.

Additionally, FIG. 2 illustrates the illumination portion 62 of the flashlight pivoted in the extreme upward position. This orientation of the illumination portion allows greater versatility in that, for example, an individual wishing to view the underside of a particular object (e.g., the underside of an automobile), can place the box in an appropriate position and orient the illumination portion 62 upwardly to illuminate the desired area. It is of course to be understood that the illumination portion 62 can be oriented at any position between the two extreme positions shown in FIGS. 1 and 2. From the foregoing, it can be appreciated that the storage box 20 is highly versatile not only because it possesses its own light source, but also because the light source is adjustable while positioned in the cover 24 of the box. This means that an individual can orient the light beam in the desired direction, using the box as a holding mechanism, and still have both hands free to perform a desired task.

In a preferred embodiment, the illumination portion 62 is designed to rotate through an angle of about 120°–150°, preferably 135°, between the two opposite extreme positions shown in FIGS. 2 and 3 (i.e., the position in which the illumination portion is directed upwardly as far as it will go and the position in which the illumination portion is directed downwardly as far as it will go).

FIG. 6 illustrates a further desirable attribute associated with the storage box of the present invention, particularly the configuration of the flashlight receiving slot 54 and the flashlight 52. As can be seen in FIG. 6, it is possible to pivot the entire flashlight 52 upwardly from the position in which the entire flashlight is received in the slot 50 to a position in which only the end of the handle portion 52 is received in the slot 50. In the position shown in FIG. 6, the flashlight 52 is oriented generally perpendicular to the cover 24. By providing a relatively close fit between the outer longitudinal sides of the handle portion 60 of the flashlight and the inner surfaces of the handle receiving portion 54 of the slot 50, the flashlight 52 can be pivoted upwardly to the position shown in FIG. 6 and frictionally maintained in position. If desired, it is possible that the sides of the handle portion 60 at the end remote from the illumination portion 62 can be provided with small protuberances that fit into corresponding recesses on the inner surfaces of the handle receiving portion 54 of the slot 50 to facilitate the pivoting action of the flashlight 52 from the position shown in FIG. 1 to the position shown in FIG. 6. Alternatively, the protuberances could be provided on the inner surfaces of the handle receiving portion 54 while the recesses are positioned on the sides of the handle portion 60.

The ability to move the flashlight 52 to the position shown in FIG. 6 provides additional versatility in that the light beam from the flashlight can be directed in directions different from those possible when the flashlight is positioned in the flashlight receiving slot 50 as illustrated in FIGS. 1–3.

As further seen with reference to FIG. 1, the storage box according to the present invention includes a handle 84 positioned on the top wall 46 of the cover 24. A comparison of FIGS. 1 and 2 shows that the handle 84 is adapted to be moved between an upright grasping position illustrated in FIG. 2 in which the handle can be grasped by an individual and a recessed stored position shown in FIG. 1 in which the handle 84 is stored below the top surface of the cover 24. The handle 84 includes a grasping portion 86 and a pair of arm portions 88, 90 positioned at opposite ends of the grasping portion 86.

The pair of arm portions includes a first arm portion 88 that is pivotally connected to the cover 24 and a second arm portion 90. The first arm portion 88 possesses a generally straight or linear configuration while the second arm portion 90 possesses a generally arcuate configuration. The first and second arm portions 88, 90 are positioned in planes that are substantially parallel to one another with the grasping portion 86 of the handle being oriented generally perpendicular to such planes.

As can be seen with reference to FIG. 3, the second arm portion 90 extends through a hole in the top wall 46 of the cover 24 so that the second arm portion can slide into and out of the interior of the cover 24 as the handle 84 is moved between the grasping position and the stored position. The free end of the second arm portion 90 is provided with an enlarged stop 92 which engages the top wall 46 of the cover 24 to stop the handle from being moved upwardly and to thereby define the upright grasping position for the handle 84.

FIG. 2 illustrates that the top wall 46 of the cover 24 is provided with a handle receiving recess 94 for receiving the handle 84 when it is in the stored position. The handle receiving recess 94 includes a region which receives the first arm portion 88 as well as a region which receives the grasping portion 86 of the handle 84. When the handle 84 is in the stored position illustrated in FIG. 1, the handle 84 is disposed below the plane defined by the exterior surface of the top wall 46 of the cover 24.

The handle 84 is particularly configured in a way that advantageously permits the handle to be moved between the upright grasping position and the recessed stored position without the need for removing the flashlight 52. As a result, the storage box can be carried without having to alter the position of the flashlight and so the light beam can be directed in the desired direction regardless of whether the handle is being used. Further, since the flashlight 52 is separate from the handle 84, the light beam from the flashlight 52 can be directed in the desired direction completely independent of the position of the handle 84. Thus, even if the handle is in the recessed stored position, the flashlight 52 can still be used to illuminate a desired area.

Figure 4:
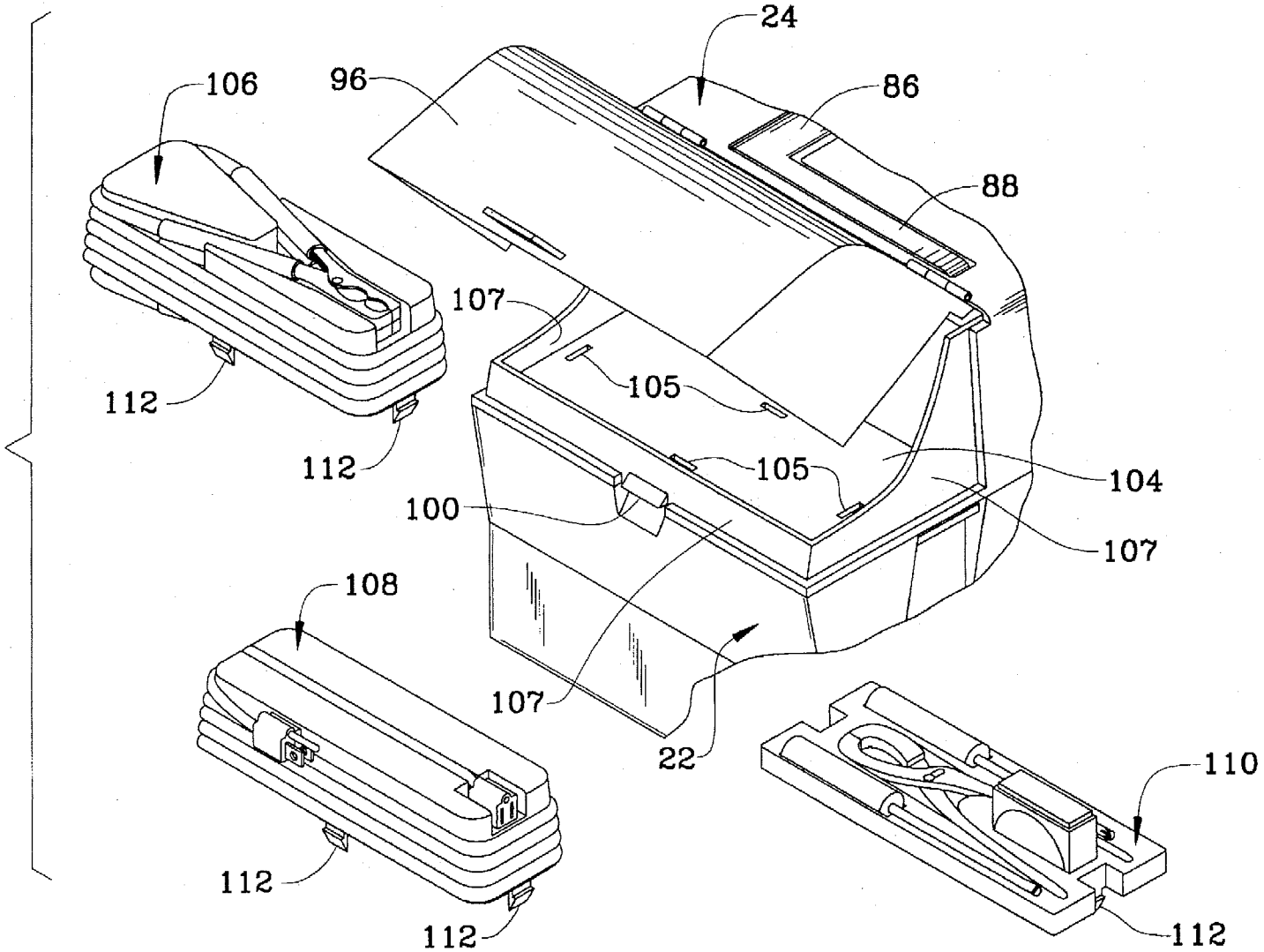
FIG. 4 is a top prospective view of a portion of the storage box shown in FIG. 1 illustrating in an exploded manner, several different accessory holding modules.

As can be seen with reference to FIGS. 1–3, a lid 96 is connected to the cover 24 by way of a pair of hinges 98 for being moved between a closed position shown in FIGS. 1–3 and an open position in which the lid 96 is pivoted upwardly. The open position of the lid is depicted in FIG. 4. The lid 96 is provided with a latch mechanism 100 to maintain the lid 96 in the closed position. In addition, a lift lever 102 is provided on the lid to facilitate the opening of the lid 96.

The lid 96 is adapted to alternately cover or permit access to a module mounting ledge 104 that forms a part of the cover 24. The module mounting ledge 104 rests on and extends across a portion of the open top of the lower box portion 22. An upstanding sidewall 107 surrounds the ledge 104 to reinforce and strengthen the ledge. The module mounting ledge 104 is provided with a plurality of slots 105 for removably mounting on the ledge 104 one of a plurality of accessory holding modules 106, 108, 110.

Each of the accessory holding modules 106, 108, 110 consists of an appropriately configured tray from which extends a plurality of retaining clips 112. The retaining clips 112 are adapted to be received in the slots 105 in the module mounting ledge 104 to removably position the respective accessory holding modules 106, 108, 110 on the module mounting ledge 104.

The first accessory holding module 106 is specifically configured to receive electrical jumper cables, the second accessory holding module 108 is specifically configured to receive an electrical extension cord, and the third accessory holding module 110 is specifically configured to receive various types of tools such as a pliers, a tape measure, and several screw drivers.

By virtue of the foregoing construction illustrated in FIG. 4, it is possible to customize the storage box to the particular needs of an individual. While the accessory holding modules illustrated in FIG. 4 are specifically configured to hold various items such as jumper cables, an electrical extension cord, and various types of tools and other implements, it is to be understood that the accessory holding modules can be configured to retain almost any type of implement or item desired. In this way, the storage box can be customized to the needs and desires of a particular individual in that it allows the storage box to be outfitted with different accessories.

Figure 5:
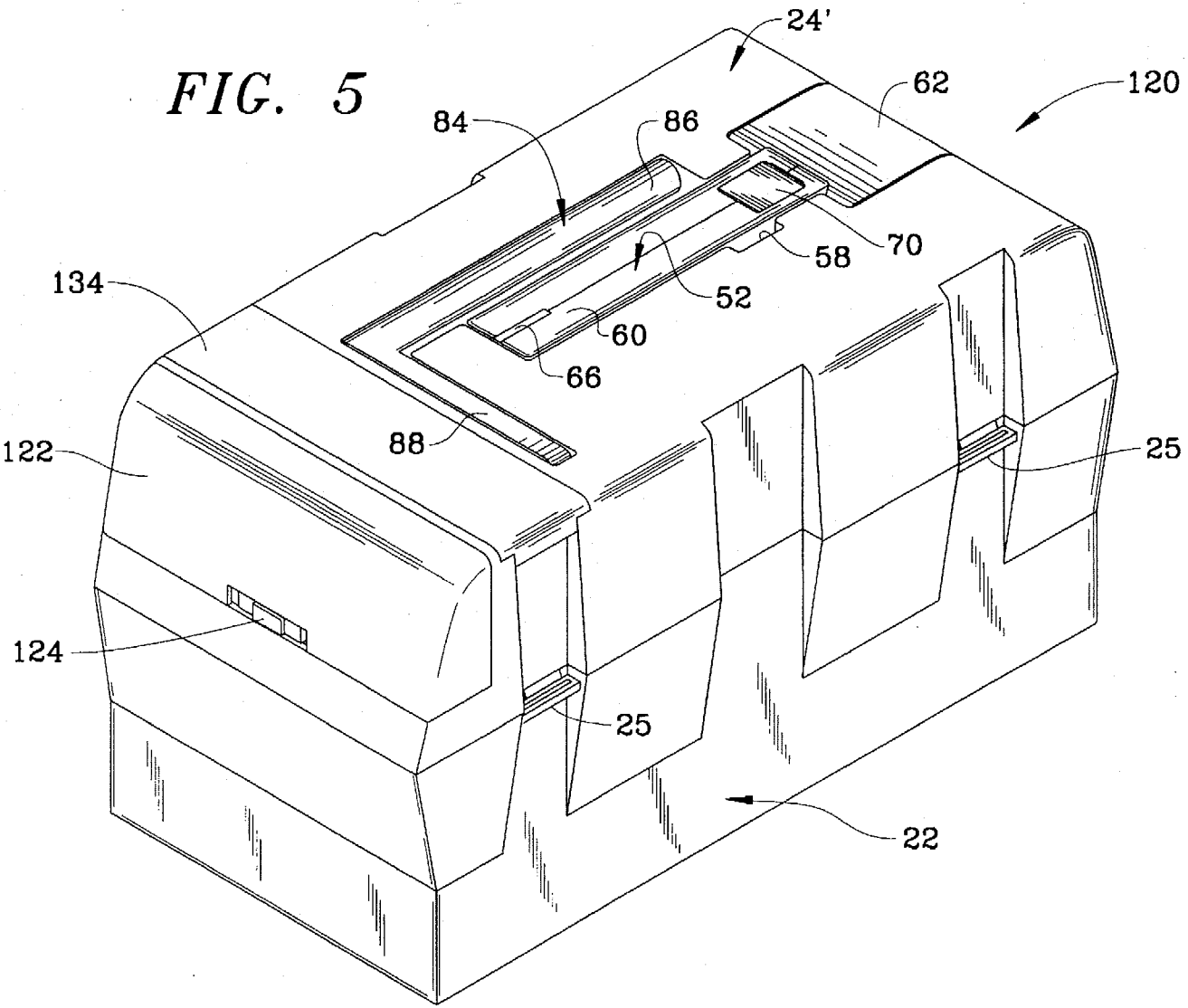
FIG. 5 is a top prospective view of a storage box in accordance with a different embodiment of the present invention.

FIG. 5 illustrates an alternative embodiment of the storage box according to the present invention. Many of the features of the storage box illustrated in the embodiment of FIG. 5 are similar to those described above and illustrated in FIGS. 1–3, 6, 7 and 9. Indeed, the lower box portion in the FIG. 5 embodiment is the same as the lower box portion in the first embodiment of the storage box 24 and many of the features associated with the lid 24' in the second embodiment are the same as those associated with the cover 24 in the first embodiment. The difference resides in that the portion of the cover in the first embodiment which is adapted to permit the mounting of different accessory holding modules is replaced with a different arrangement. As seen in FIG. 5, the second embodiment of the storage box includes a cover 24' outfitted with an emergency warning light feature and a covered storage receptacle.

The emergency warning light or flasher consists of a cover 122 provided at one end of the storage box 120. An on-off button 124 is disposed on the cover 122 to effect the on and off operation of the emergency flasher. As seen with reference to FIG. 8, the cover 122 encloses a space in which is mounted a flashing light bulb 126. The cover 122 can be colored (e.g., red) so that the emergency flasher is readily observable.

A pair of batteries 128 are positioned in a recessed area within the cover 24' to provide a power source for the light bulb 126. As can be seen, the batteries 128 are generally centered within the cover and with respect to the storage box as a whole to facilitate balancing of the storage box. Similarly, the flashlight 52 is positioned in the cover so that the batteries 64 for the flashlight 52 are generally centered in the cover 24'. This arrangement of the batteries for the flashlight is also characteristic of the first embodiment of the storage box described above. It is also to be noted that the batteries 128 for the emergency flasher are of the same size as the batteries 64 for the flashlight (e.g., D size batteries). Thus, the batteries for the emergency flasher can be used in the flashlight 52 should the batteries 64 for the flashlight 52 become drained.

The cover 24' is also provided with a relatively deep receptacle 130. In the embodiment of the invention illustrated in FIG. 8, the receptacle 130 is adapted to receive a radio 132. The radio 132 is preferably removably positioned within the receptacle 130 but can be configured so that it can be tuned and turned on and off and while disposed in the receptacle 130. Of course, the receptacle 130 can be used to hold items other than a radio 132.

As seen with reference to FIG. 5, the receptacle 130 is covered by a removable lid 134. The lid 134 and the cover 24' can be appropriately configured to retain the lid in place 134 on the cover 24' and avoid inadvertent removal of the lid 134, while at the same time allowing the lid 134 to be removed for access to the receptacle 130.

Figure 8:
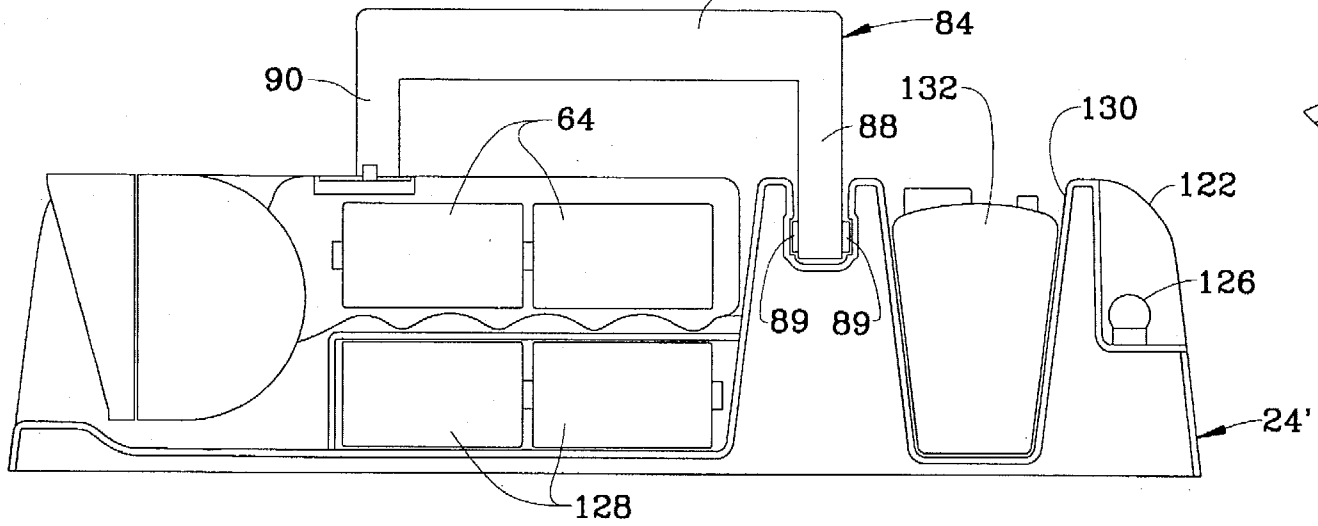
FIG. 8 is a cross-sectional view of the storage box shown in FIG. 5.

While the embodiment of the storage box according to the present invention shown in FIGS. 5 and 8 is illustrated as including both an emergency flasher as well as a storage receptacle, it is to be understood that the cover could be appropriately configured to provide only the emergency flasher or only the storage receptacle.

FIG. 8 also illustrates one way in which the first arm portion 88 of the handle 84 can be pivotally mounted on the cover. As seen, the first arm portion 88 of the handle 84 can be provided with oppositely positioned bosses 89 that are received in corresponding boss receiving detentes in the cover. This same arrangement is preferably utilized in both embodiments of the storage box.

FIG. 5 also illustrates the hinges 25 that are provided for hingedly connecting the cover of the storage box to the lower box portion in both embodiments of the storage box.

As mentioned above, the various embodiments of the storage box described above utilize the same lower box portion. This greatly facilitates the manufacturing process and reduces manufacturing costs since different forms of the storage box can be fabricated by simply utilizing different covers having the appropriate features and configuration. In addition, the entire box and substantially the entire flashlight can be injection molded from plastic polpropylene, thereby further reducing the cost associated with manufacturing the entire box.

The present invention provides a storage box that is also highly useful and versatile, and that possesses a variety of advantageous attributes. The provision of the flashlight mounted on the cover provides the storage box with a source of light that can be used in a variety of contexts. In one respect, the light can serve to illuminate the area in front of an individual carrying the storage box. Alternatively, the light can be used to illuminate a particular working area for an individual. In this regard, the storage box functions as a mechanism for holding the light source so that the individual's hands are free to perform a desired task. Further, since the illumination portion of the flashlight is adjustable, and since the flashlight itself is movable to an upright position with respect to the cover of the storage box, the light beam can be directed in a wide variety of different directions.

The fact that the flashlight is removable from the storage box also contributes to the usefulness and versatility of the present invention. Moreover, since the flashlight is completely independent of the handle, and since the handle is movable between the grasping and stored positions without having to alter the position of the flashlight, the usefulness of the light source is not constrained. That is, the handle need not be in a particular position or orientation for the flashlight to be effective.

The configuration of the storage box which allows modules containing different accessories to be associated with the storage box is also quite advantageous in that it allows the storage box to be customized to the needs and requirements of a particular individual. In this regard, one type of storage box can be manufactured and this box can then be sold in conjunction with a variety of different accessory holding modules. Individuals could then purchase the storage box and one or more of the accessory holding modules specifically adapted to meet their needs. Further accessory holding modules could then be purchased at a later date.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A storage box for storing a variety of items, comprising:

a lower box portion having an open top and a plurality of side walls bounding a recessed storage area for receiving a variety of items;

a cover connected to the lower box portion and movable from one position in which the open top of the lower box portion is covered and another position in which the cover is moved away from the open top of the lower box portion to the storage area in the lower box portion;

means provided in said cover for removably receiving means, said flashlight a flashlight removably received in the flashlight receiving means, said flashlight including a handle portion and an illumination portion, said illumination portion being pivotally connected to the handle portion so that with the flashlight positioned in the flashlight receiving means the illumination portion of the flashlight is pivotable relative to the handle portion to direct a beam of light from the illumination portion in different directions.

2. A storage box as claimed in claim 1, including a handle mounted on a top portion of the cover, said handle being movable from a grasping position for allowing the handle to be grasped and a stored position in which the handle is stored.

3. A storage box as claimed in claim 2, wherein said cover includes a recess which receives the handle when the handle is in the stored position.

4. A storage box as claimed in claim 1, wherein said handle includes a grasping portion and an arm portion extending from each end of the grasping portion, one of the arm portions being rotatably mounted on the cover and the other arm portion extending through an opening in the cover for sliding relative to the cover as the handle moves between the grasping position and the stored position.

5. A storage box as claimed in claim 1, wherein said illumination portion of the flashlight is pivotable in a plane substantially perpendicular to a top of said cover.

6. A storage box as claimed in claim 1, wherein said illumination portion of the flashlight is movable at least between one position in which the illumination portion of the flashlight faces the cover so that the illumination portion is shielded by the cover and another position in which the illumination portion is oriented generally along a longitudinal axis of the handle portion.

7. A storage box as claimed in claim 1, wherein said flashlight receiving means includes a recess formed in a top exterior surface of the cover.

8. A storage box as claimed in claim 1, wherein said cover includes a ledge which extends over a portion of the lower box portion and rests on the lower box portion, said ledge being provided with mounting means for removably mounting. one of a plurality of differently configured accessory holding modules for holding an accessory.

9. A storage box for storing a variety of items, comprising:

a lower box portion having an open top and a plurality of walls bounding a recessed storage area for receiving a variety of items;

a cover connected to the lower box portion and movable from one position in which the open top of the lower box portion is covered and another position in which the cover is moved away from the open top of the lower box portion to expose the storage area in the lower box portion;

a ledge extending across a portion of the top of the lower box portion while leaving another portion of the top uncovered;

a handle mounted on the cover for carrying the storage box;

mounting means provided on the ledge for removably mounting one of a plurality of differently configured accessory holding modules;

an accessory holding module removably mounted on the mounting means for holding an accessory, the accessory holding module being separable from the mounting means on the ledge to permit a different accessory holding module to be mounted on the mounting means on the ledge.

10. A storage box as claimed in claim 9, wherein said accessory holding module is one of an accessory holding module on which is disposed an electrical extension cord, an accessory holding module on which is disposed electrical jumper cables, and an accessory holding module on which is disposed at least one screw driver.

11. A storage box as claimed in claim 9, including a movable lid mounted on the cover for covering the ledge, said lid being movable between a closed position in which the ledge is covered and an open position in which the ledge is uncovered.

12. A storage box as claimed in claim 11, wherein said ledge forms a part of the cover, said lid being hingedly mounted on the cover.

13. A storage box as claimed in claim 9, wherein said handle includes a grasping portion and an arm portion extending from each end of the grasping portion, one of the arm portions being rotatably mounted on the cover and the other arm portion extending through an opening in the cover for sliding relative to the cover as the handle is moved between the grasping position and the stored position.

14. A storage box as claimed in claim 9, including a slot provided in an exterior top surface of the cover, and a flashlight removably positioned in the slot.

15. A storage box as claimed in claim 14, wherein the flashlight includes a handle portion and an illumination portion, said illumination portion being rotatably connected to the handle portion, and said illumination portion being rotatable relative to the handle portion while the flashlight is received in the slot in the cover.

16. A storage box for storing a variety of items, comprising:

a lower box portion having an open top and a plurality of side walls bounding a recessed storage area for receiving a variety of items;

a cover connected to the lower box portion and movable from one position in which the open top of the lower box portion is covered and another position in which the cover is moved away from the open top of the lower box position to expose the storage area in the lower box portion;

flashlight receiving means provided in the cover for receiving a flashlight;

a flashlight removably received in the flashlight receiving means, said flashlight including a handle portion and an illumination portion;

a handle receiving recess provided in the cover; and a handle movably mounted on the cover for movement between a stored position in which the handle is received in the handle receiving recess and a grasping position in which the handle is adapted to be grasped for carrying the storage box, said handle being movable between the stored position and the grasping position while the flashlight is positioned in the flashlight receiving means.

17. A storage box as claimed in claim 16, wherein said illumination portion of the flashlight is rotatably mounted on the handle portion of the flashlight, said illumination portion of the flashlight being rotatable relative to the handle portion of the flashlight while the flashlight is positioned in the flashlight receiving means.

18. A storage box as claimed in claim 16, wherein said handle includes a grasping portion and an arm portion extending from each end of the grasping portion, one of the arm portions being rotatably mounted on the cover and the other arm portion extending through an opening in the cover for sliding relative to the cover as the handle is moved between the grasping position and the stored position.

19. A storage box as claimed in claim 16, wherein said cover is hingedly connected to the lower box portion.

20. A storage box as claimed in claim 16, wherein said cover includes a ledge which extends over a portion of the lower box portion and rests on the lower box portion, said ledge being provided with mounting means for removably mounting one of a plurality of differently configured accessory holding modules for holding an accessory, said ledge forming a portion of the cover.

21. A storage box as claimed in claim 20, including an accessory holding module removably mounted on the mounting means, and including a lid hingedly connected to the cover for movement between a closed position in which the ledge is covered and an open position in which the ledge is uncovered to permit access to the accessory holding module.

* * * * *